US006664457B1

(12) United States Patent
King

(10) Patent No.: US 6,664,457 B1
(45) Date of Patent: Dec. 16, 2003

(54) PERCUSSION INSTRUMENT AID

(76) Inventor: Douglas King, 1185 W. University 13-106, Flagstaff, AZ (US) 86001

( * ) Notice: Subject to any disclaimer, the term of this patent is extended or adjusted under 35 U.S.C. 154(b) by 0 days.

(21) Appl. No.: 09/783,684

(22) Filed: Feb. 15, 2001

(51) Int. Cl.[7] ..... G10D 13/08
(52) U.S. Cl. ..... 84/402; 84/403; 84/404; 84/422.1
(58) Field of Search ..... 84/402–404, 406, 84/411 P, 422.1–422.4

(56) References Cited

U.S. PATENT DOCUMENTS

| | | | | |
|---|---|---|---|---|
| 437,744 A | * | 10/1890 | Zeller | 84/402 |
| 706,230 A | * | 8/1902 | Fuller | 84/402 |
| 3,022,603 A | * | 2/1962 | Kawabata | 446/166 |
| 3,704,646 A | | 12/1972 | Grauso et al. | |
| 4,185,808 A | | 1/1980 | Donohoe et al. | |
| 5,337,646 A | | 8/1994 | Austin | |
| 5,341,716 A | | 8/1994 | Donohoe | |
| 5,408,913 A | | 4/1995 | Hoshino | |

FOREIGN PATENT DOCUMENTS

| | | | |
|---|---|---|---|
| GB | 2234045 | * | 1/1991 |

* cited by examiner

*Primary Examiner*—Shih-Yung Hsieh
(74) *Attorney, Agent, or Firm*—Ellis & Venable, P.C.

(57) ABSTRACT

The present invention, a percussion instrument aid is useful to aid in the creation of acoustic vibrations, or more generally, music. The subject instrument includes a striking pad and a striking tip, positioned distally on a lever arm. Further, the lever arm is pivotally attached at a pivot joint to a brace, the brace having a percussion device attached distally from where the lever arm is pivotally attached. The instrument aid is used by displacing the striking pad with a force conveyed by a hand. As the striking pad is displaced, the pivotally attached lever arm is also displaced thereby causing a complementary displacement of the striking tip. The displacement of the striking tip eventually impacts upon the percussive device causing the characteristic vibrations of the percussive device.

17 Claims, 9 Drawing Sheets

PERCUSSION INSTRUMENT AID

FIELD OF THE INVENTION

The present invention relates to the field of aids to enable the play of percussion instruments. More particularly, the present invention relates to structures implementing a means to impact a percussion device. Ever more particularly, the present invention relates to the field of structures designed to transfer, the force imparted by a hand, to a percussion device, resulting in the characteristic acoustic vibrations of the percussion device. The present invention also relates to the field of aids to assist with physical therapy.

BACKGROUND

While there are percussion instruments, namely bongo drums, that are used, or played, using only the hands, percussion instruments are more commonly used by a musician using drumsticks. Accordingly, drumsticks that are grasped by a musician, such as those taught by U.S. Pat. No. 5,341,716 issued to Donohoe ("Donohoe '716") are fairly ordinary in the art. Most inventions in the art related to the present invention provide the means for accommodating instruments that are played using grasped drumsticks. However, those who choose not to use drumsticks, or those unable to grasp drumsticks, are not accommodated. It would be desirable to accommodate those individuals who either choose not to use drumsticks, or who are unable to use drumsticks.

The ordinary way in which various percussion instruments are accommodated for use is taught in the related art. For instance, U.S. Pat. No. 3,704,645 issued to Grauso et al. ("Grauso"), U.S. Pat. No. 5,337,646 issued to Austin ("Austin"), U.S. Pat. No. 4,185,808 issued to Donohoe et al. ("Donohoe '808") teaches devices for supporting percussion instruments that are typically played with drumsticks. The utility of the structures taught by these patents is in the ability to accommodate multiple sizes and types of percussion instruments, organized in multiple combinations, and situated at various angles. However, these patents however do not teach a structure for permitting play with other than a musician's drumstick. Moreover, the devices that are taught by these patents are generally suited to relatively complex percussion arrangements.

Another type of percussion instrument support is taught in U.S. Pat. No. 5,408,913 issued to Hoshino ("Hoshino"). Hoshino teaches a stand for a bass drum. The Hoshino stand is particularly suited for a bass drum and does not, nor intends to, teach a means or method of support instruments other than bass drums. Moreover, the Hoshino device teaches a foot driven pedal to play the bass drum. Thus, the Hoshino device is also not suited to be played by hand.

Thus, a desirable characteristic of a percussion instrument would be the ability to accommodate the desire to play by hand. Additionally, it would be desirable to accommodate the physically disabled. In particular, it would be desirable to be able to play a variety of percussion instruments without requiring the use of a drumstick. Not Grauso, Austin, Donohoe '808 nor Hoshino teach either of these accommodations. Thus, there is a need for a aid to playing percussion type instruments that obviates holding a musicians drumstick, and that facilitates the play of percussion instruments by those unable to hold a musicians drumstick.

SUMMARY OF THE INVENTION

It is an object of the present invention to provide a structural aid to playing percussion instruments. It is another object of the invention to provide a structural instrument aid that allows playing of percussion instruments with the force imparted by a hand. It is a further object of the present invention to provide an aid to playing percussion instruments that permits adjustment of said force imparted necessary to enable play of the percussion instrument.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to limit the scope of the invention. Rather, the scope of the invention described herein is limited only by the claims appended hereto.

Figure 1:
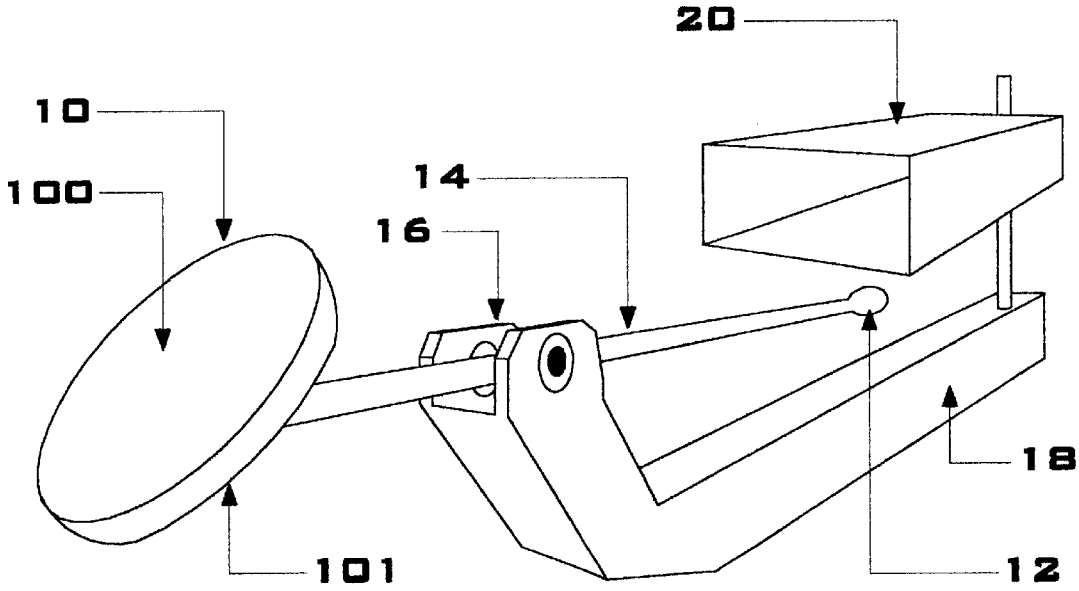
FIG. 1 depicts an embodiment of the subject invention using a bell.

The present invention, a percussion instrument aid 1, is useful to aid in the creation of acoustic vibrations, or more generally, music. The subject instrument 1 comprises a striking pad 10 and a striking tip 12, positioned distally on a lever arm 14. Further, said lever arm 14 is pivotally attached at a pivot joint 16 to a brace 18, said brace 18 having a percussion device 20 attached distally from where said lever arm 14 is pivotally attached. FIG. 1 depicts the subject instrument aid 1.

Most commonly, the instrument aid 1 is used by displacing the striking pad 10 with a force conveyed by a hand. The imparted force may range in magnitude and be relatively gentle or comparatively severe. The actual force to be used is determined by the musician who is using the device and depends on the acoustic effect desired. As the striking pad 10 is displaced, the pivotally attached lever arm 14 is also displaced thereby causing a complementary displacement of the striking tip 12. The displacement of the striking tip 12 eventually impacts upon the percussive device 20 causing the characteristic vibrations of the percussive device 20.

The striking pad 10 of the subject instrument 1, comprises a striking pad surface 100, a back side 101, and a striking pad attachment joint 102. A rigid material composes the structure of the striking pad 10. Metals, woods, plastics or other equivalent rigid materials provide the best materials of construction. A properly constructed pad 10 will be rigid enough to transfer substantially all of the force from a hand strike upon the pad 10. Additionally, the pad 10 is structurally robust to withstand repeated hand strikes.

Preferably, the surface 100 of the striking pad 10 is covered by relatively firm padding. The padding may be attached by any means ordinary in the art. Firm padding permits a more efficient transfer of force from a hand strike and also avoids an excessive time lapse between, a hand strike upon the pad 10, and the impact of the striking tip 12 upon the percussion device 20. Padding 102 on the striking pad surface 100 is also preferred to avoid hand trauma due to repeated hand strikes. The preferred padding 102 is foam rubber, however, the actual type of padding may be any material ordinary in the art that achieves the desired characteristics.

Figure 2:
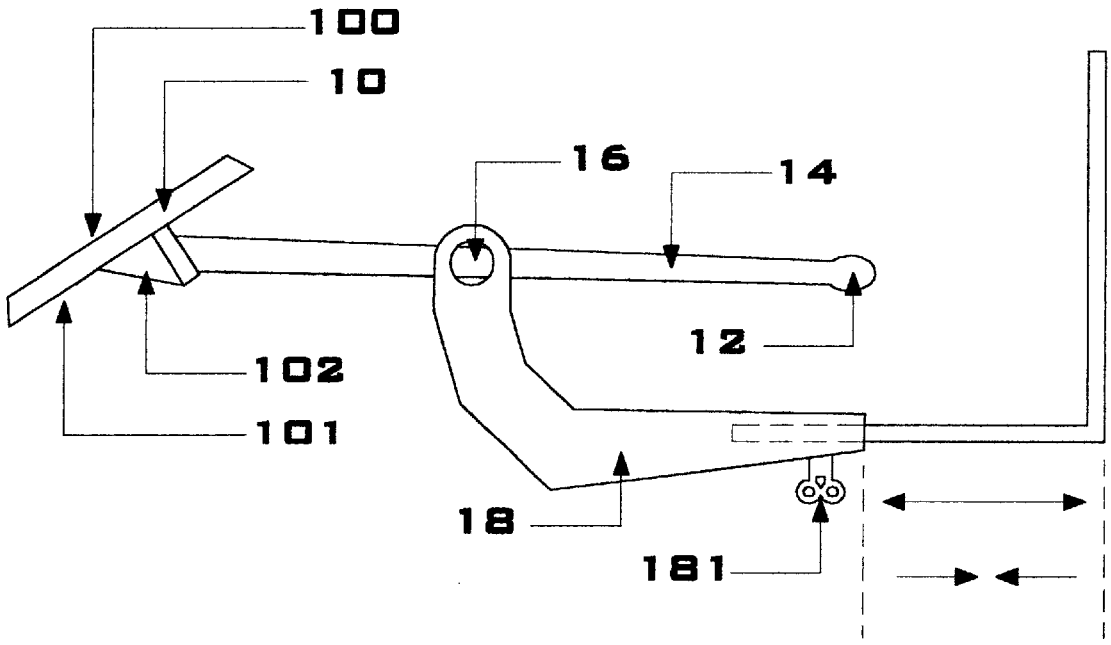
FIG. 2 depicts an embodiment having adjustable striking pad length and brace length.
Figure 3:
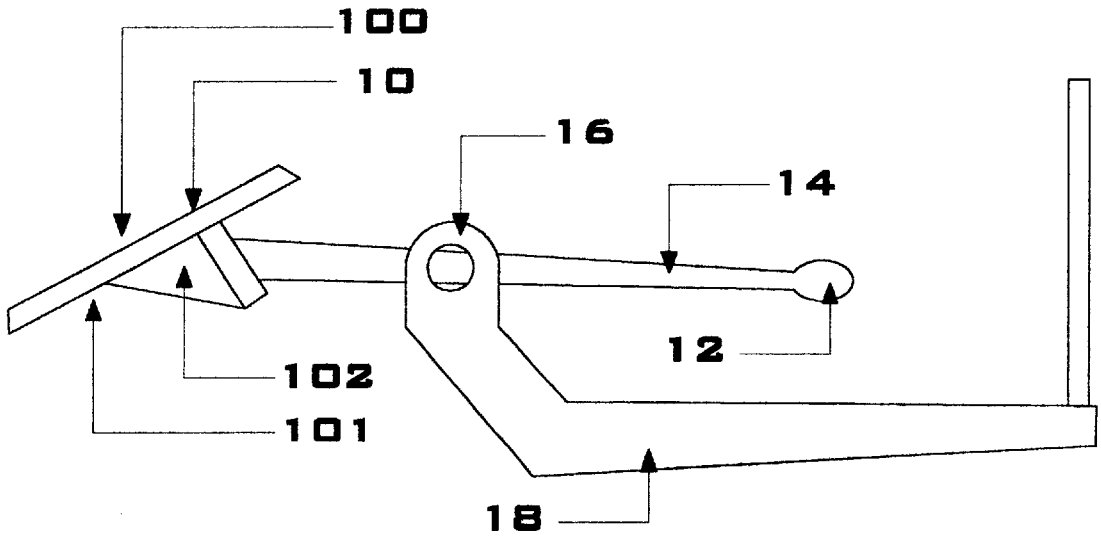
FIG. 3 depicts an embodiment having static striking pad angle and brace length.

Generally, the back side 101 of the striking pad 10 is uncovered material that is used to construct the string pad 10. The striking pad attachment joint 102 is preferably swiveling, such as with a butterfly screw, to enable securing various particular angles for the striking pad 10. An embodiment with a swiveling joint 102 is depicted in FIG. 2. A swivel joint permits many alternate angles for the striking pad surface 100. Alternately, the attachment joint 102 may be non swiveling such that the end of the arm 18 to which the striking pad 10 is attached is a platform onto which the striking pad 10 is attached with screws or any other equivalent fastener. Such joint 102 is depicted in FIG. 3.

The striking tip 12 of the instrument aid 1 is generally an exposed knob composed of the construction material of the lever arm 14 and positioned at a distal end from where the striking pad 10 is attached. As with drumsticks, musicians often desire alternate striking tip 12 compositions to affect different sounds. Thus, tip 12 compositions desirable to ordinarily skilled practitioners and musicians are contemplated for use with the invention.

Similar to the back side 101 of the striking pad 10, the lever arm 14 of the instrument aid 1 is also composed of rigid material such as metal, wood or plastic. Generally, the lever arm 14 has the dimensional ratio of an ordinary musical drumstick. Preferably however, the size of the lever arm 14 is roughly five to ten percent (5%–10%) larger than an ordinary musical drumstick. The lever arm 14 is pivotally attached by a pivot joint 16 to a brace 18.

Although the pivot joint 16 could be embodied using one spring, the preferred pivot joint 16 is embodied in dual spring gears 160 comprising first and second springs, 161 and 162 respectively, recessed within first and second cavities, 163 and 164 respectively. Said first and second springs, 161 and 162, having end segments 1611, 1612 and 1621, 1622 projecting perpendicular to the cylinders formed by the helicoid of the springs, and said first end segments being received by apertures in the pivot joint 16 of the brace 18. The springs of the pivot joint function to retain the lever arm 14 in the cocked, or ready, position before a hand strike, and return the lever arm 14 to the cocked position after a hand strike. The springs, 161 and 162, of the pivot joint 16 are contemplated to be standard off-the-shelf spiral springs.

Figure 4:
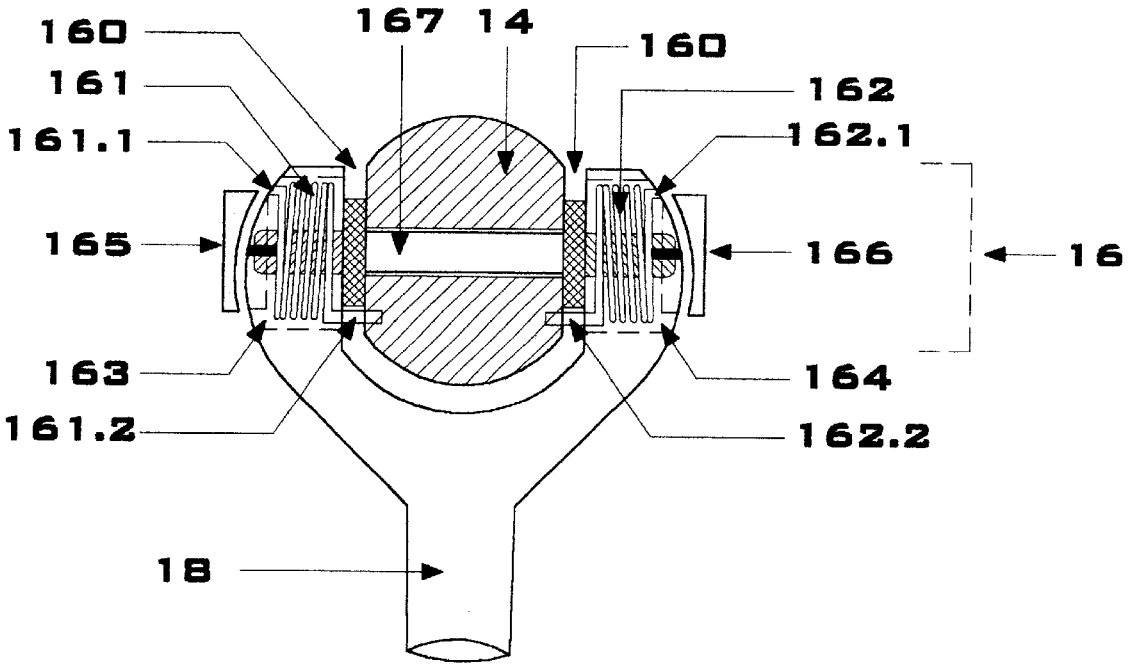
FIG. 4 depicts a close view of the pivot joint of the subject invention.

Both first and second cavities, 163 and 164, are positioned at a distal end of the brace 18 and are fashioned either by milling or by cast molding. FIG. 4 depicts the preferred design of the spring mechanism 160. First and second end caps, 165 and 166 respectively, enclose the cavities, 163 and 164, and are attached to the pivot joint 16 by threads tapped on the walls of the cavities, 163 and 164. A shaft 167, extending through each end of the lever arm 14 provides the pivot axis of the lever arm 14, and is secured by cavities in the end caps 165 and 166. Preferably the end caps, 165 and 166, and the shaft 167 will rotate upon bearings located in the end of the lever arm 14. End cap washers having a notch in the perimeter and a notch in the inner aperture can be used to secure the end segments, 1612 and 1622, of the springs, 161 and 162, and the shaft 167.

Figure 5:
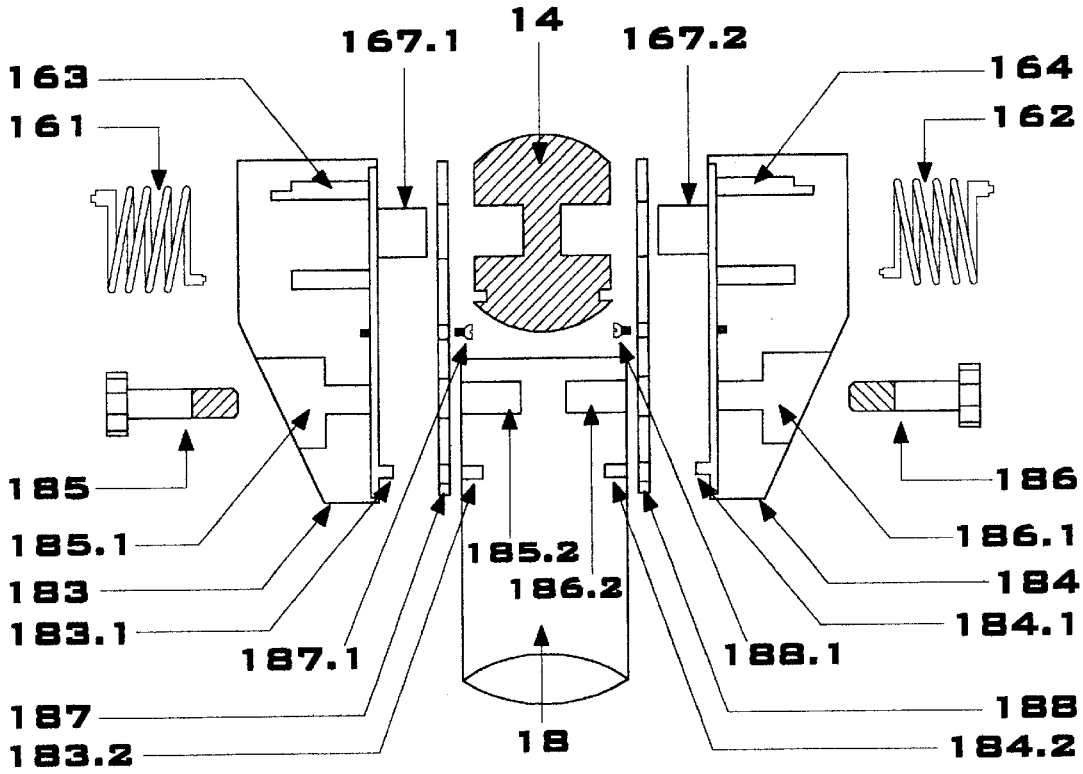
FIG. 5 depicts a close view of another pivot joint implementation.
Figure 6:
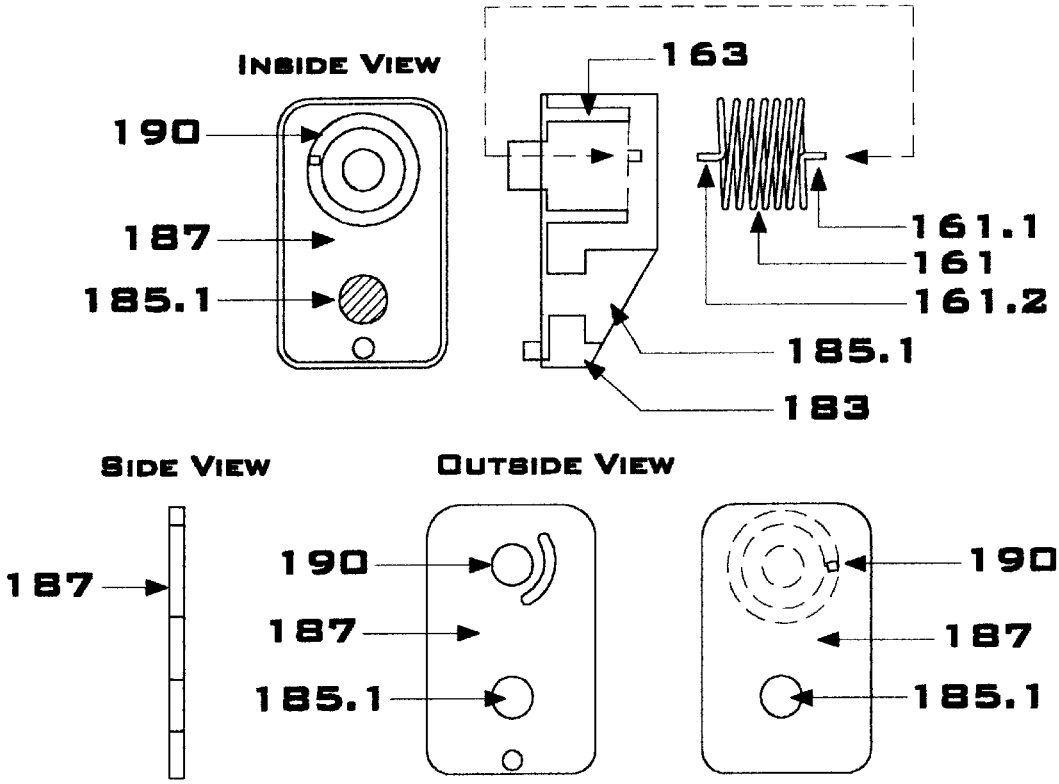
FIG. 6 depicts a variable tension spring implementation of the pivot joint.
Figure 7:
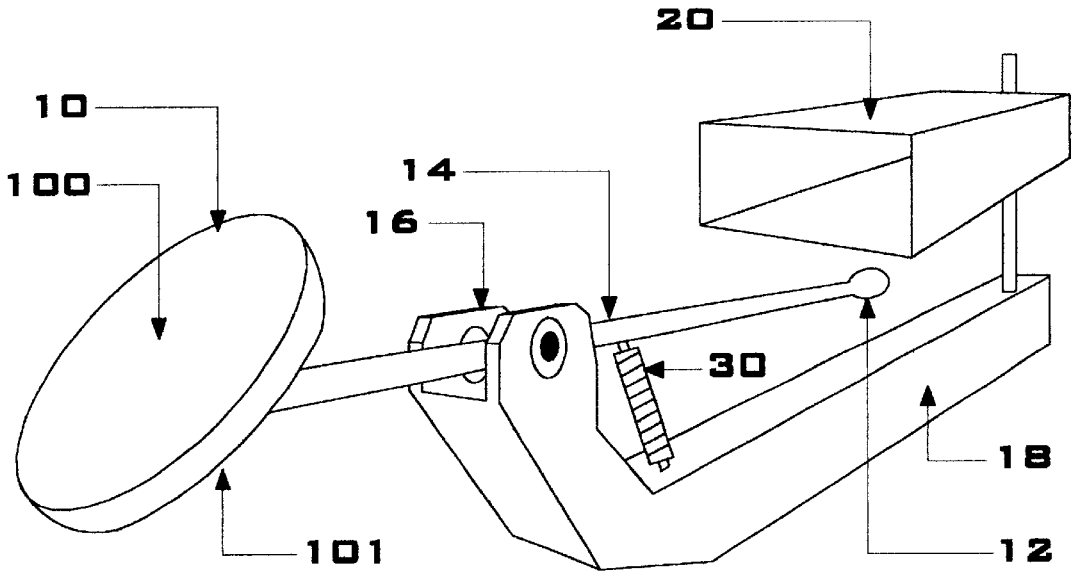
FIG. 7 depicts an embodiment of the subject invention using a single leaf spring.

The spring mechanism 160 of the pivot joint 16 is also capable of alternate designs having different levels of complexity. For instance, FIGS. 5 and 6 show a relatively complex design of the pivot joint 16 having numerous pieces. On the other hand, FIG. 7 shows a relatively simple single leaf spring 30 design. The embodiment of FIGS. 5 and 6 features adjustable tension, whereas the embodiment of FIG. 7 requires changing of the leaf spring 30 to affect the tension of the lever arm 14.

The embodiment depicted in FIG. 5 shows an exploded view of one design of the pivot joint 16. In addition to the aforementioned components of the instrument aid 1, the embodiment depicted in FIG. 5 comprises: two pivot joint heads, 183 and 184 having spring cavities, 163 and 164, two semi-shafts, 1671 and 1672 upon which the lever arm 14 pivots, at least one anti-slip tab, 1831 and 1841 with corresponding anti-slip tab receiving apertures on the lever arm, 1832 and 1842; at least one head retaining screw, 185 and 186, with corresponding head retaining screw apertures, 1851 and 1861, and lever arm retaining screw apertures, 1851 and 1861; two retaining plates, 187 and 188, having at least two plate retaining screws, 1871 and 1881, and apertures for said head retaining screw, 185 and 186, said semi-shafts, 1671 and 1672, said anti-slip tab, 1831 and 1841, and said plate retaining screws, 1871 and 1881.

FIG. 6 shows how the embodiment of FIG. 5 can be designed to implement variable coil tension in the springs 161 and 162. Coil tension in springs, 161 and 162, of the lever arm 14 refers to the force required to cause the desired impact of the striking tip 12 and the percussion device 20 and to the characteristic manner in which the arm 14 returns to the default position. Variable coil tension in the springs, 161 and 162, permits the instrument aid 1 to be used by many different individuals with varying strength capability.

Referring to FIG. 6, the two retaining plates, 187 and 188, further comprise a ratcheting mechanism 190 for the spring end segments, 1611, 1612 and 1621, 1622, such that discrete increments of tension are possible. The design of the ratchet mechanism 190 can be accomplished by any means applicable in the art for imparting variable coil tension to springs.

For a relatively strong musician, the springs 161 and 162, could be coiled relatively tightly so that the striking pad 10 of the lever arm 14 must be forced relatively hard to cause an impact of the striking tip 12 with the percussion device 20. Accordingly, for this relatively tight setting, the lever arm 14 would recoil quickly back to the default position to await the next hand strike. Conversely, for a less strong musician, the springs 161 and 162, could be coiled relatively loosely so that less force is required to cause impact of the striking tip 12 upon the percussion device 20. Variable tension and recoil is particularly useful when the instrument aid 1 is being used as a physical therapy aid for individuals with diminished strength. As the individual's strength improves, the coil tension of the springs, 161 and 162, can be increased to provide progressively challenging physical therapy.

Figure 8:
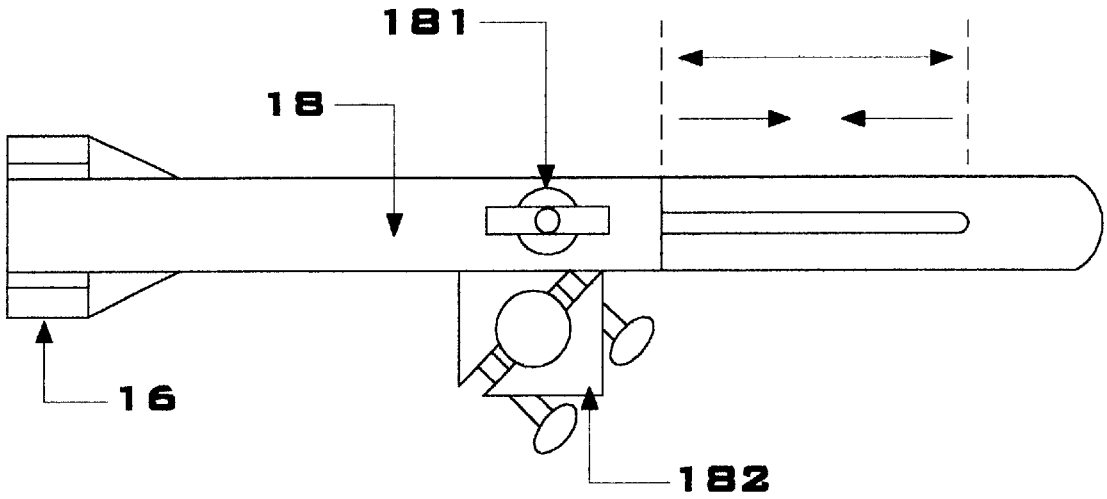
FIG. 8 depicts a top view an adjustable brace of the present invention with a stand attachment joint.

The brace 18 of the subject invention is preferably fashioned from woods, metals, plastics or an equivalent thereof. Generally, the brace 18 supports and couples the lever arm 14 and the percussion device 20. More particularly, the brace 18 is adjustable for alternate angles and lengths. FIG. 8 depicts a two segment brace 18, with telescoping segments, which is lengthened by a butterfly pressure screw 181. Moreover, a brace attachment joint 182 is included to removably attach the instrument aid to a stand to accommodate a drum set. FIG. 8 is depicted without the lever arm 14 and without the striking pad 10 or percussion device 20 for clarity.

Figure 9:
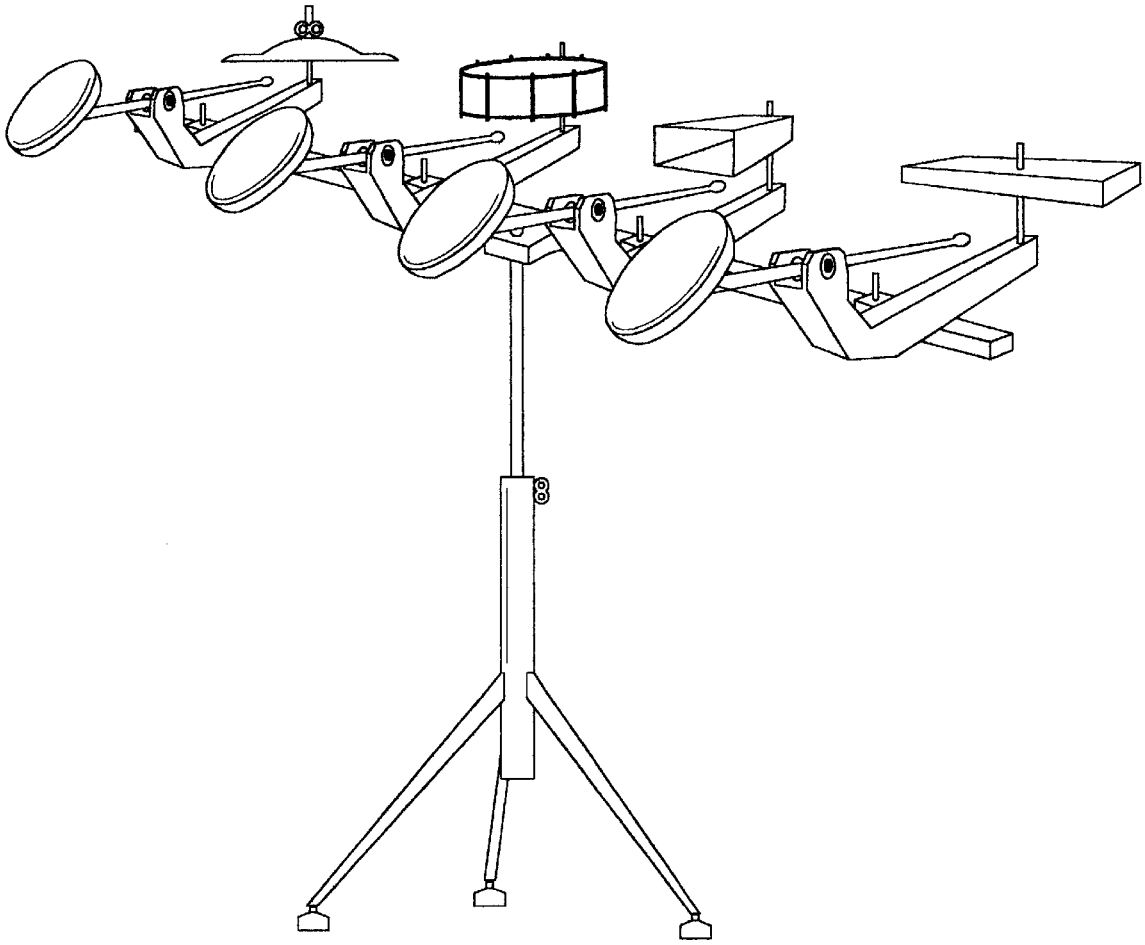
FIG. 9 depicts an implementation of multiple instrument aids as used by a musician.

The percussion device 20 of the instrument aid 1 can be any percussion instrument capable of being attached to the brace 18. Generally, it is contemplated that bells, drums, symbols and other ordinary percussion instruments will be used. These instruments can either be removably attached, much in the same way that they're attached currently in the art, or manufactured to be a permanent part of the brace 18 of the aid 1. FIG. 9 depicts a multi-percussion device 20 embodiment of the subject invention.

What is claimed is:

1. An aid for percussion devices comprising;

a striking pad, and a striking tip, said striking pad and said striking tip each being distally positioned on a lever arm, pivotally attached at a medial position of said lever arm to a brace, said brace further attached to a percussion device distally positioned on said brace, whereby a musician plays said musical instrument by imparting force to said striking pad and said pivotally attached lever arm, thereby displacing said lever arm and causing an impact of said striking tip with said percussion device.

2. The aid in claim 1 wherein the striking pad is securably attached to the lever arm by a swiveling striking pad attachment joint that permits securing alternate angles of said striking pad.

3. The aid in claim 1 wherein the percussion device is removably attached so as to permit accommodate the use of alternate percussion devices.

4. The aid in claim 1 wherein said lever arm is pivotally attached to said brace by a pivot joint comprising at least one spring.

5. The aid in claim 4 wherein said pivot joint further comprises at least one spring gear further comprising;

at least one spring recessed within at least one spring cavity positioned in said pivot joint of said brace, wherein said spring is biased so as to force the striking tip away from the percussion device.

6. The aid in claim 5 wherein said at least one spring gear is capable of variable coil tension.

7. The aid in claim 1 wherein said brace is at least two pieces that allow for changing the distal position of said percussion device relative to said medial position of said lever arm.

8. The aid in claim 1 wherein said brace is at least two pieces joined by one or more pivot joints that permit alteration of the relative position of said striking pad and said percussion device.

9. A physical therapy aid comprising;

a striking pad, and at least one striking tip, said striking pad and said striking tip each being distally positioned on at least one lever arm, pivotally attached at a medial position of said lever arm to at least one brace, said brace further attached to at least one percussion device distally positioned on said brace, whereby an individual undergoing physical therapy uses said aid by imparting force to said striking pad and said pivotally attached lever arm, thereby displacing said lever arm and causing an impact of said striking tip with said percussion device.

10. The aid in claim 9 wherein the striking pad is securably attached to the lever arm by a swiveling striking pad attachment joint that permits securing alternate angles of said striking pad.

11. The aid in claim 9 wherein the percussion device is removably attached so as to permit accommodate the use of alternate percussion devices.

12. The aid in claim 9 wherein said lever arm is pivotally attached to said brace by a pivot joint comprising at least one spring.

13. The aid in claim 12 wherein said pivot joint further comprises at least one spring gear further comprising;

at least one spring recessed within at least one spring cavity positioned in said pivot joint of said brace, wherein said spring is biased so as to force the striking tip away from the percussion device.

14. The aid in claim 13 wherein said at least one spring gear is capable of variable coil tension.

15. The aid in claim 9 wherein said brace is at least two pieces that allow for changing the distal position of said percussion device relative to said medial position of said lever arm.

16. The aid in claim 9 wherein said brace is at least two pieces joined by one or more pivot joints that permit alteration of the relative position of said striking pad and said percussion device.

17. A method of making acoustic vibrations comprising the step of;

displacing a striking pad and a striking tip by imparting force to said striking pad, said striking pad being distally positioned on a lever arm, and said striking tip positioned at a second distal position of said lever arm said displacing causing pivoting of said lever arm about a pivotal attachment to a brace, said pivotal attachment being medially positioned on said lever arm, causing an impact of said striking tip with a percussion device distally positioned from said medial position of said lever arm.

* * * * *